US009574316B2

(12) United States Patent
Han et al.

(10) Patent No.: US 9,574,316 B2
(45) Date of Patent: Feb. 21, 2017

(54) SUCTION FOUNDATION HAVING ENHANCED SELF-WEIGHT PENETRATION AND CONSTRUCTION METHOD THEREOF

(71) Applicant: Korea Institute of Ocean Science & Technology, Gyeonggi-do (KR)

(72) Inventors: Taek Hee Han, Seoul (KR); Jin-Hak Yi, Gyeonggi-do (KR); Young Hyun Park, Gyeonggi-do (KR); Jin Soon Park, Gyeonggi-do (KR)

(73) Assignee: KOREA INSTITUTE OF OCEAN SCIENCE & TECHNOLOGY, Gyeonggi-do (KR)

( * ) Notice: Subject to any disclaimer, the term of this patent is extended or adjusted under 35 U.S.C. 154(b) by 0 days.

(21) Appl. No.: 15/081,094

(22) Filed: Mar. 25, 2016

(65) Prior Publication Data

US 2016/0289911 A1 Oct. 6, 2016

(30) Foreign Application Priority Data

Apr. 2, 2015 (KR) ..... 2015-0046732

(51) Int. Cl.

| | |
|---|---|
| ***E02D 27/52*** | (2006.01) |
| ***E02D 27/10*** | (2006.01) |
| ***E02D 23/08*** | (2006.01) |
| ***E02D 23/04*** | (2006.01) |

(52) U.S. Cl.

CPC ..... *E02D 27/525* (2013.01); *E02D 23/04* (2013.01); *E02D 23/08* (2013.01); *E02D 27/10* (2013.01); *E02D 2250/0053* (2013.01)

(58) Field of Classification Search

CPC . E02D 2250/0053; E02D 27/52; E02D 27/525

USPC ..... 405/224.1; 114/296

See application file for complete search history.

(56) References Cited

U.S. PATENT DOCUMENTS

| | | | | |
|---|---|---|---|---|
| 2,938,353 | A * | 5/1960 | Vorenkamp | B63B 21/26 405/205 |
| 4,270,480 | A * | 6/1981 | Hancock | B63B 21/27 114/296 |
| 6,360,682 | B1 * | 3/2002 | Riemers | B63B 21/27 114/296 |
| 6,481,932 | B1 * | 11/2002 | Riemers | E02B 17/021 114/266 |

(Continued)

FOREIGN PATENT DOCUMENTS

| | | |
|---|---|---|
| KR | 10-1175206 B1 | 8/2012 |
| KR | 10-1199348 B1 | 11/2012 |

*Primary Examiner* — Frederick L Lagman

(74) *Attorney, Agent, or Firm* — Dentons US LLP

(57) ABSTRACT

The present relates to a suction foundation in which is penetrated into the seabed by a vacuum pressure of a suction pump, thereby providing a desired foundation support force. The suction foundation includes a hollow caisson having an opening at a lower end thereof, where the suction pump is connected to the hollow caisson and the suction pump allows the hollow caisson to penetrate into the seabed while discharging a fluid in the hollow caisson to an outside thereof by using the vacuum pressure of the suction pump, a lower skirt provided along a circumference of the opening of the hollow caisson and formed into a wave shape having a series of teeth, and having wedge-shaped cross-sections, and a stiffener increasing rigidity of the lower skirt by increasing thickness of a predetermined portion of the lower skirt.

5 Claims, 9 Drawing Sheets

(56) References Cited

U.S. PATENT DOCUMENTS

| | | | | |
|---|---|---|---|---|
| 7,527,455 | B2 * | 5/2009 | Raines | B63B 21/27<br>114/296 |
| 7,661,905 | B2 * | 2/2010 | Alhayari | B63B 21/27<br>114/296 |
| 8,684,629 | B2 * | 4/2014 | Asplund | E02D 27/52<br>405/224 |

* cited by examiner

SUCTION FOUNDATION HAVING ENHANCED SELF-WEIGHT PENETRATION AND CONSTRUCTION METHOD THEREOF

CROSS-REFERENCE TO RELATED APPLICATION

This application claims priority to Korean Patent Application No. KR 2015-0046732 filed on Apr. 2, 2015 and all the benefits accruing therefrom under 35 U.S.C. §119, the contents of which are incorporated by reference in their entirety.

BACKGROUND OF THE INVENTION

Field of the Invention

The present invention generally relates to a suction foundation. More particularly, the present invention relates to a suction foundation having an enhanced self-weight penetration, whereby when the suction foundation is landed on a seabed by its own weight, the suction foundation is penetrated into the seabed by a vacuum pressure of a suction pump, thereby providing a desired foundation support force.

Background

Generally, a suction foundation is a foundation for providing a foundation support force to install a structure in the sea.

Normally, penetration of a foundation has been performed by vibrating, striking, or water jetting, but in recent years, a suction foundation has been widely used, whereby the suction foundation penetrates into a seabed by difference of hydraulic pressures generated between an inside and an outside of the suction foundation by a suction pump.

To be specific, a hollow caisson of the suction foundation penetrates into the seabed while a water pump forcefully discharges a fluid in the hollow caisson to an outside thereof after the hollow caisson having an opening at a lower end thereof and having a tub shape is penetrated into the seabed by its own weight.

That is, the suction foundation requires being penetrated into the seabed by its own weight before the water pump forcefully discharges fluid in the hollow caisson to the outside thereof.

A penetration caused by the self-weight of the suction foundation is required to be performed at an initial stage for installing the suction foundation, which is very important, since whether the suction foundation can be penetrated into a seabed by suction of the water pump depends on an amount of initial self-weight penetration of the suction foundation when the suction foundation is landed on the seabed by its own weight. When the amount of the initial self-weight penetration is small, suction pressure of the water pump may leak, thereby making the penetration of the suction foundation impossible.

To solve the above-mentioned problem, technologies have been developed to increase an amount of initial self-weight penetration of the suction foundation.

As a related art of the present invention, there is a suction pile presented in "Piling Apparatus of Suction Pile" disclosed in Korean Patent No. 10-1175206 (patent document 1).

According to the related art, as shown in FIG. 8, the piling apparatus of suction pile includes: a suction pile 1 penetrating into the seabed; the suction pump 2 provided on an outer surface of the suction pile 1, the suction pump 2 discharging water in the suction pile 1 to an outside thereof; and a rotating part 3 rotating the suction pile 1.

Here, as shown in FIG. 8, the suction pile 1 of the related art is provided with a series of teeth 1*a* formed along a circumference of a lower end of the suction pile 1. Due to the sharp ends of the teeth 1*a*, the suction pile 1 can stably land on the seabed, thereby increasing the amount of initial self-weight penetration of the suction pile 1.

However, when the suction pile 1 of the related art lands on a hard seabed, the series of teeth 1*a* may be deformed or damaged by the hard seabed, so the suction pile 1 may fail to perform efficient penetration.

Meanwhile, although the piling apparatus of suction pile according to the related art is configured to rotate the suction pile 1 by the rotating part 3 so as to efficiently penetrate the suction pile 1 into the seabed, the suction pile 1 can be forcefully rotated only by the rotating part 3, but it is impossible to induce the suction pile 1 to rotate on its own.

In addition, referring to a suction pile disclosed in Korean Patent No. 10-1199348 (patent document 2) as another related art, the suction pile is provided with an end shoe formed into the shape of a saw blade at a lower end of the suction pile, thereby increasing the amount of initial self-weight penetration of the suction pile, but there is no element capable of preventing the end shoe from being damaged. Thus, the suction pile may fail to perform efficient penetration, and further, this technology cannot induce a rotation of the penetrating suction pile.

The information disclosed in the Background of the Invention section is only for the enhancement of understanding of the background of the invention, and should not be taken as an acknowledgment or as any form of suggestion that this information forms a prior art that would already be known to a person skilled in the art.

DOCUMENTS OF RELATED ART (Patent Document 1) Korean Patent No. 10-1175206
(Patent Document 2) Korean Patent No. 10-1199348

SUMMARY OF THE INVENTION

Accordingly, the present invention has been made keeping in mind the above problems occurring in the related art, and the present invention is intended to propose a suction foundation having enhanced self-weight penetration, and a construction method thereof, in which a hollow caisson is formed into a wave shape having a series of teeth along the circumference of a lower end thereof, the hollow caisson being penetrated into a seabed by suction pressure, thereby increasing the amount of initial self-weight penetration, and the lower end of the hollow caisson is reinforced to increase the rigidity thereof, thereby being prevented from being deformed or damaged.

In addition, the present invention is further intended to propose a suction foundation having enhanced self-weight penetration, and a construction method thereof, in which the suction foundation allows the hollow caisson to efficiently penetrate into a seabed by allowing rotation of the hollow caisson to be guided by an element for reinforcing the lower end having the wave shape.

In order to achieve the above object, according to one aspect of the present invention, there is provided a suction foundation having an enhanced self-weight penetration, the suction foundation penetrated into a seabed by a vacuum pressure of a suction pump, and providing a foundation support force, the suction foundation including: a hollow caisson having an opening at a lower end thereof and formed into a tub shape, the hollow caisson introducing fluid on a seabed through the opening thereinto while the hollow caisson is landed on the seabed by a self-weight thereof, wherein the suction pump is connected to the hollow caisson, the suction pump allowing the hollow caisson to penetrate into the seabed while discharging the fluid in the hollow caisson to an outside thereof by using the vacuum pressure of the suction pump; a lower skirt provided along a circumference of the opening of the hollow caisson and formed into a wave shape having a series of teeth, and having wedge-shaped cross-sections, the lower skirt being penetrated into the seabed by using the teeth thereof when the hollow caisson is landed initially on the seabed by the self-weight thereof; and a stiffener increasing rigidity of the lower skirt by increasing thickness of a predetermined portion of the lower skirt.

For example, the stiffener may include a reinforcing blade protruding from each of the teeth that constitute the lower skirt and extending along a longitudinal direction of the hollow caisson, the reinforcing blade increasing the rigidity of the teeth.

Here, the reinforcing blade may be provided by protruding from at least one surface of an outer circumferential surface and an inner circumferential surface of the hollow caisson.

Further, the reinforcing blade vertically may protrude along the longitudinal direction of the hollow caisson.

Unlike the above-mentioned configuration, the reinforcing blade may protrude along the longitudinal direction of the hollow caisson to form a helical shape or a screw shape.

According to another aspect of the present invention, there is provided a construction method of the suction foundation having the above-mentioned configuration, the method including: preparing the suction foundation by constructing a hollow caisson provided with a reinforcing blade protruding from a lower skirt of the hollow caisson; docking a suction pump on the hollow caisson by connecting the suction pump to the hollow caisson; landing the hollow caisson on a seabed after putting the hollow caisson into the sea; suctioning fluid for penetrating the hollow caisson into the seabed while discharging the fluid in the hollow caisson to an outside of the hollow caisson by operation of the suction pump; and undocking the suction pump from the hollow caisson by removing the suction pump therefrom.

Here, in the preparing of the suction foundation, the reinforcing blade may be provided by protruding from the lower skirt and the hollow caisson to form a helical shape or a screw shape, and in the suctioning, the hollow caisson may be rotated by the reinforcing blade having the helical shape or the screw shape during penetration of the hollow caisson into the seabed.

According to the present invention, the suction foundation having enhanced self-weight penetration having the above-mentioned configuration is provided with the lower skirt formed into a wave shape having a series of teeth at a lower end of the hollow caisson, and thus when the hollow caisson initially lands on the seabed, the amount of initial self-weight penetration increases, thereby efficiently creating suction pressure in the hollow caisson, and particularly, the lower skirt is reinforced by the reinforcing blade constituting the stiffener, so rigidity and durability of the lower skirt are increased, and thus the lower skirt is prevented from being deformed or damaged even when the hollow caisson penetrates into a hard seabed.

In addition, when the reinforcing blade according to the present invention protrudes from the inner circumferential surface and the outer circumferential surface of the hollow caisson, the rigidity and durability of the lower skirt are further increased.

Furthermore, when the reinforcing blade according to the present invention vertically protrudes along a longitudinal direction of the caisson, the hollow caisson can vertically and efficiently penetrate into a seabed.

Furthermore, when the reinforcing blade according to the present invention protrudes along the longitudinal direction of the hollow caisson to form a helical shape or a screw shape, the hollow caisson is rotated by guidance of the reinforcing blade during penetration of the hollow caisson into the seabed, thereby making penetration of the hollow caisson into the seabed more efficient, and providing a desired foundation support force.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE PRESENTLY PREFERRED EMBODIMENTS

Exemplary embodiments of the present invention will be described more fully hereinafter with reference to the accompanying drawings. In the following description of the present invention, detailed descriptions of known functions and components incorporated herein will be omitted when it may make the subject matter of the present invention unclear.

Reference will now be made in detail to various embodiments of the present invention, specific examples of which are illustrated in the accompanying drawings and described below, since the embodiments of the present invention can be variously modified in many different forms. While the present invention will be described in conjunction with exemplary embodiments thereof, it is to be understood that the present description is not intended to limit the present invention to those exemplary embodiments. On the contrary, the present invention is intended to cover not only the exemplary embodiments, but also various alternatives, modifications, equivalents and other embodiments that may be included within the spirit and scope of the present invention as defined by the appended claims.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between", "directly between", "adjacent to", or "directly adjacent to" should be construed in the same way.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Figure 1:
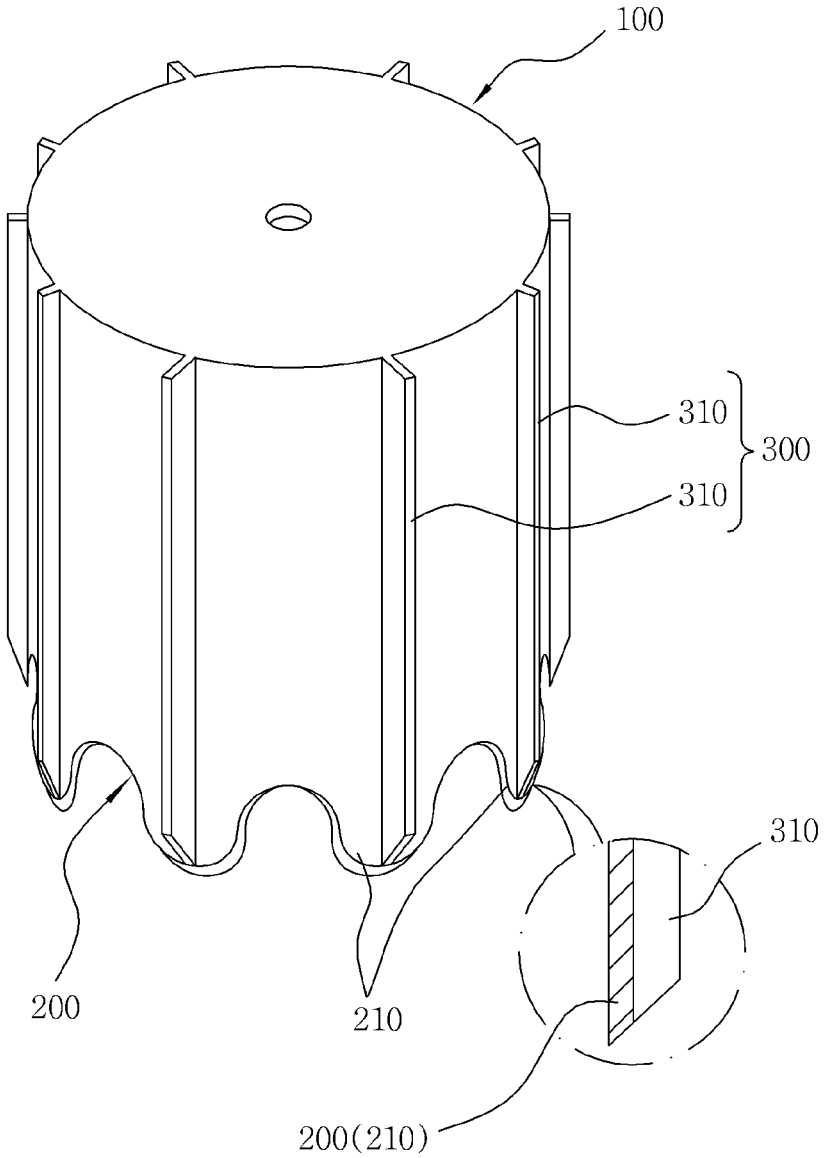
FIG. 1 is a perspective view showing a suction foundation according to an embodiment of the present invention.

According to the present invention, as shown in FIG. 1, the suction foundation having an enhanced self-weight penetration may include: a hollow caisson 100, a lower skirt 200, and a stiffener 300.

Figure 2:
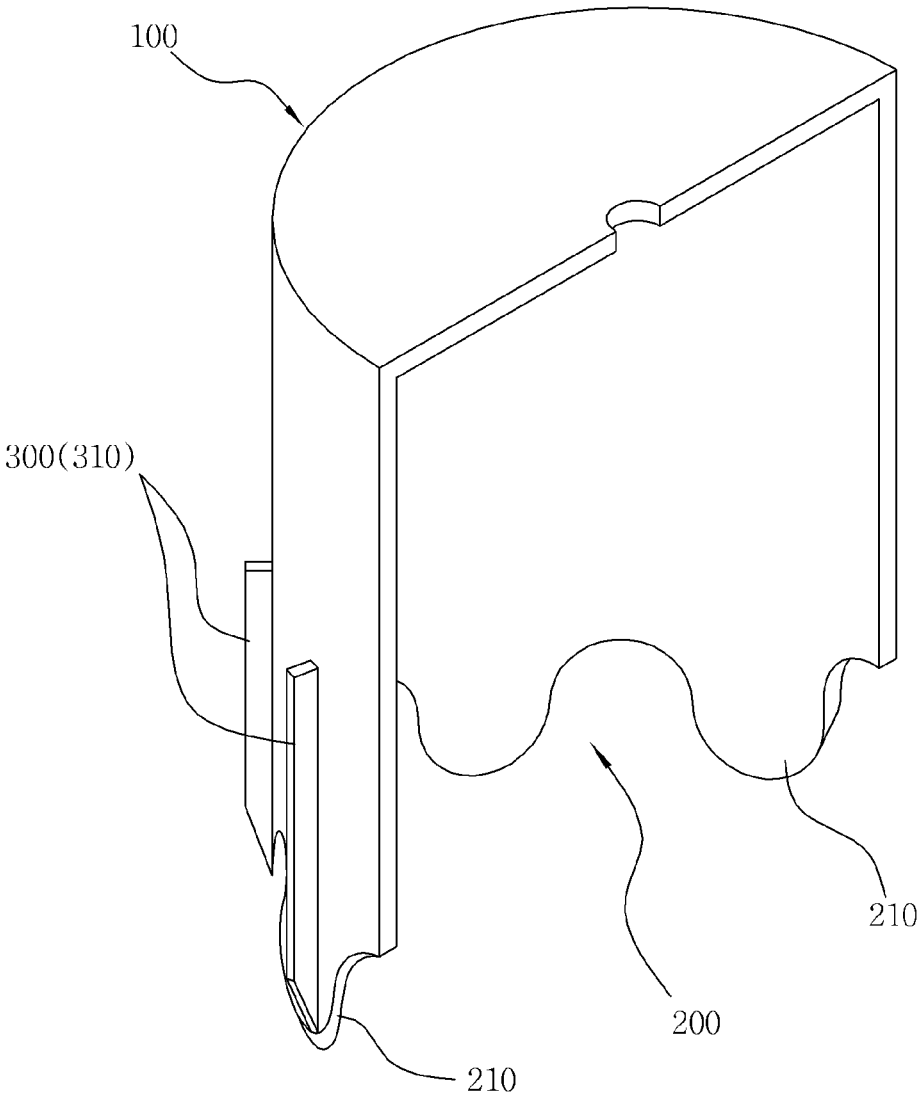
FIG. 2 is a cut perspective view showing the suction foundation according to the embodiment of the present invention.

The hollow caisson 100 is a member for providing a foundation support force for installing a structure in the sea by being penetrated into a seabed using a vacuum pressure of a suction pump. As shown in FIGS. 1 and 2, the hollow caisson 100 is formed into a tub shape having an opening at the lower end thereof.

To install the hollow caisson 100 on the seabed, the hollow caisson 100 is landed on the seabed by its own weight, as shown in FIGS. 7A to 7E. When the hollow caisson 100 is landed on the seabed, the lower skirt 200, which will be described in detail later herein, having an opening at the lower end thereof is penetrated into the seabed to a predetermined depth by the caisson's own weight. In this case, water in the hollow caisson 100 is discharged to an outside of the caisson by operation of the suction pump P connected to the hollow caisson 100. In this case, the hollow caisson 100 does not allow water to be introduced thereinto through any other parts of the hollow caisson 100 other than the opening of the lower end, and thus pressure in the hollow caisson 100 decreases, which causes a difference in pressure between the inside and the outside of the hollow caisson 100. Due to the pressure difference, the hollow caisson 100 is penetrated into the seabed.

Here, the penetration inducement rate of the hollow caisson 100 is proportional to the square of the pressure difference and a diameter of the hollow caisson 100, whereas resistance to the penetration inducement rate is proportional to the diameter of the hollow caisson 100. Accordingly, as the diameter of the hollow caisson 100 increases, even small amount of pressure difference allows penetration of the hollow caisson into the seabed.

In addition, the hollow caisson 100 has another technological characteristic that when it is required to remove the hollow caisson 100 from the seabed, positive pressure can be created in the hollow caisson 100 by introducing fluid into the hollow caisson 100, and thus the hollow caisson 100 can be easily pulled out from the seabed.

Here, as shown in FIG. 1, the hollow caisson 100 may be configured as a cylindrical structure having a circular cross-section, or may be configured as a polygonal tub structure having a polygonal cross-section. Additionally, it is preferred that the hollow caisson 100 is made of steel or concrete.

The lower skirt 200 is an element for increasing the amount of the self-weight penetration when the hollow caisson 100 is landed initially on the seabed. As shown in FIG. 1, the lower skirt 200 is provided along the circumference of a lower end of the hollow caisson 100, and is formed into a wave shape having a series of teeth, with wedge-shaped cross-sections formed at the lower end.

Since the lower skirt 200 has the wedge-shaped cross-sections, the hollow caisson 100 can initially penetrate into the seabed by using the teeth 210 of the lower skirt 200. Thus, when the hollow caisson 100 lands on the seabed, the lower skirt 200 can increase the amount of the self-weight penetration of the hollow caisson 100 into the seabed.

Here, as shown in FIGS. 1 and 2, the lower skirt 200 may be formed integrally with the hollow caisson 100. Alternatively, the lower skirt 200 may be detachably mounted to the lower end of the hollow caisson 100.

The stiffener 300 is an element to increase the rigidity of the lower skirt 200 so the stiffener 300 can prevent the lower skirt 200 from being deformed or damaged by the seabed.

As shown in FIG. 1, the stiffener 300 may include a reinforcing blade 310 protruding from each of the teeth 210 that constitute the lower skirt 200. Here, the reinforcing blade 310 increases the thickness of the teeth 210, thereby increasing the rigidity of the teeth 210.

That is, as shown in FIG. 1, the reinforcing blade 310 protrudes from the outer circumferential surface of each of the teeth 210, and extends in a longitudinal direction of the hollow caisson 100, thereby increasing the rigidity of the lower skirt 200.

Figure 3:
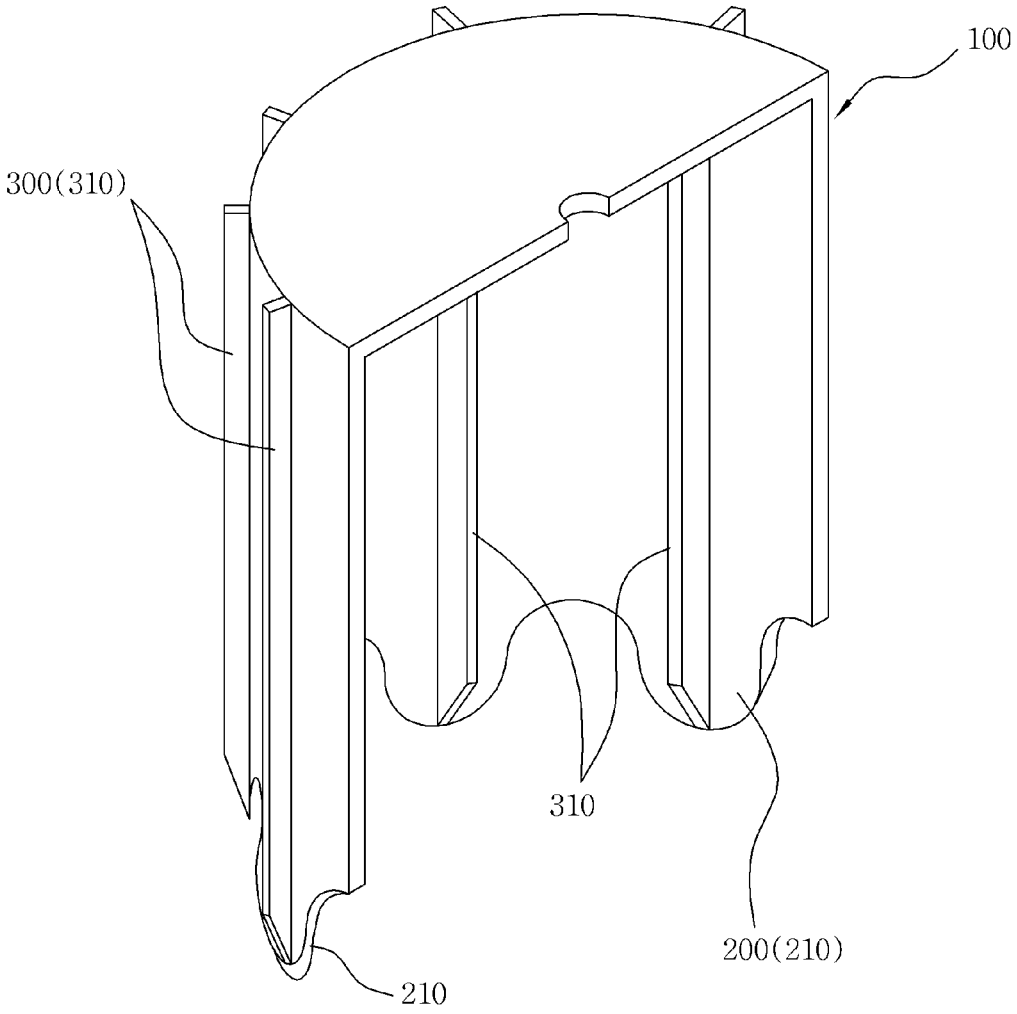
FIG. 3 is a cut perspective view showing a reinforcing blade according to another embodiment of the present invention.

As shown in FIGS. 1 and 3, the reinforcing blade 310 may extend to an upper part of the hollow caisson 100, or as shown in FIG. 2, the reinforcing blade 310 may extend only to a predetermined part of the hollow caisson 100.

Figure 4:
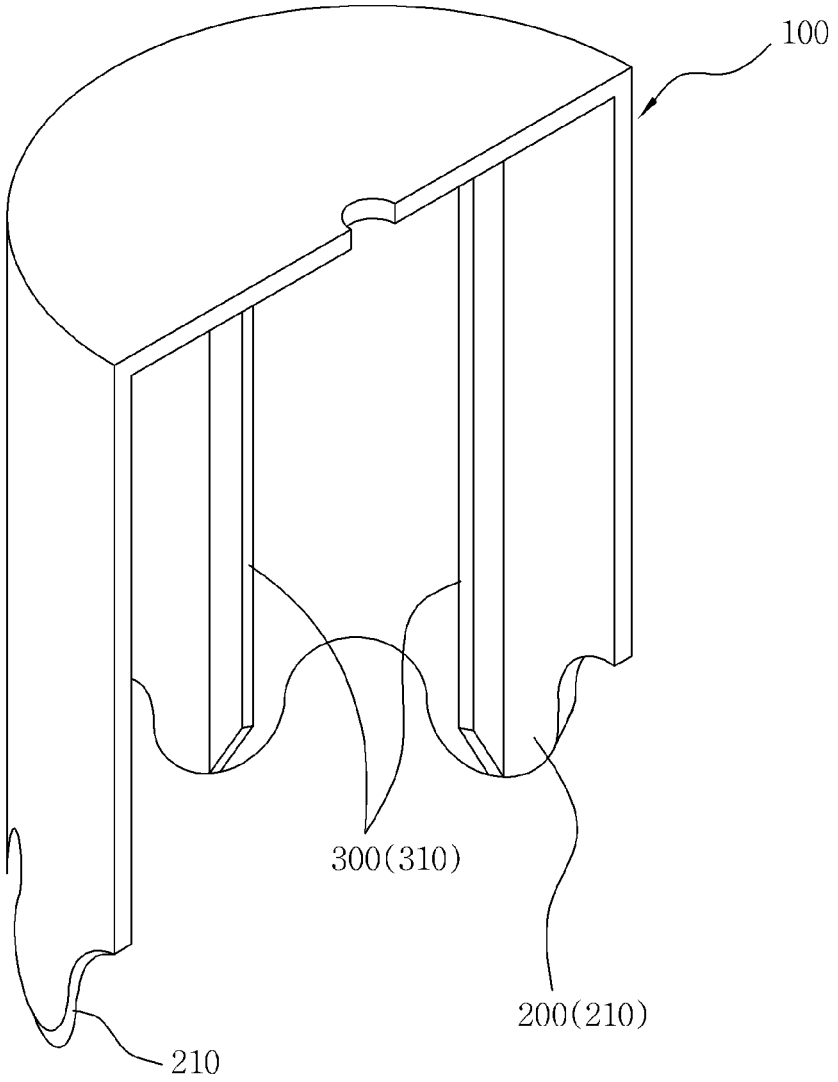
FIG. 4 is a cut perspective view showing a reinforcing blade according to still another embodiment of the present invention.

In addition, as shown in FIGS. 1 and 2, the reinforcing blade 310 may protrude from the outer circumferential surface of the hollow caisson 100, or as shown in FIG. 4, the reinforcing blade 310 may protrude only from the inner circumferential surface of the hollow caisson 100.

Unlike the above-mentioned configuration, as shown in FIG. 3, the reinforcing blade 310 may protrude both from the inner circumferential surface and from the outer circumferential surface of the hollow caisson 100.

Figure 5:
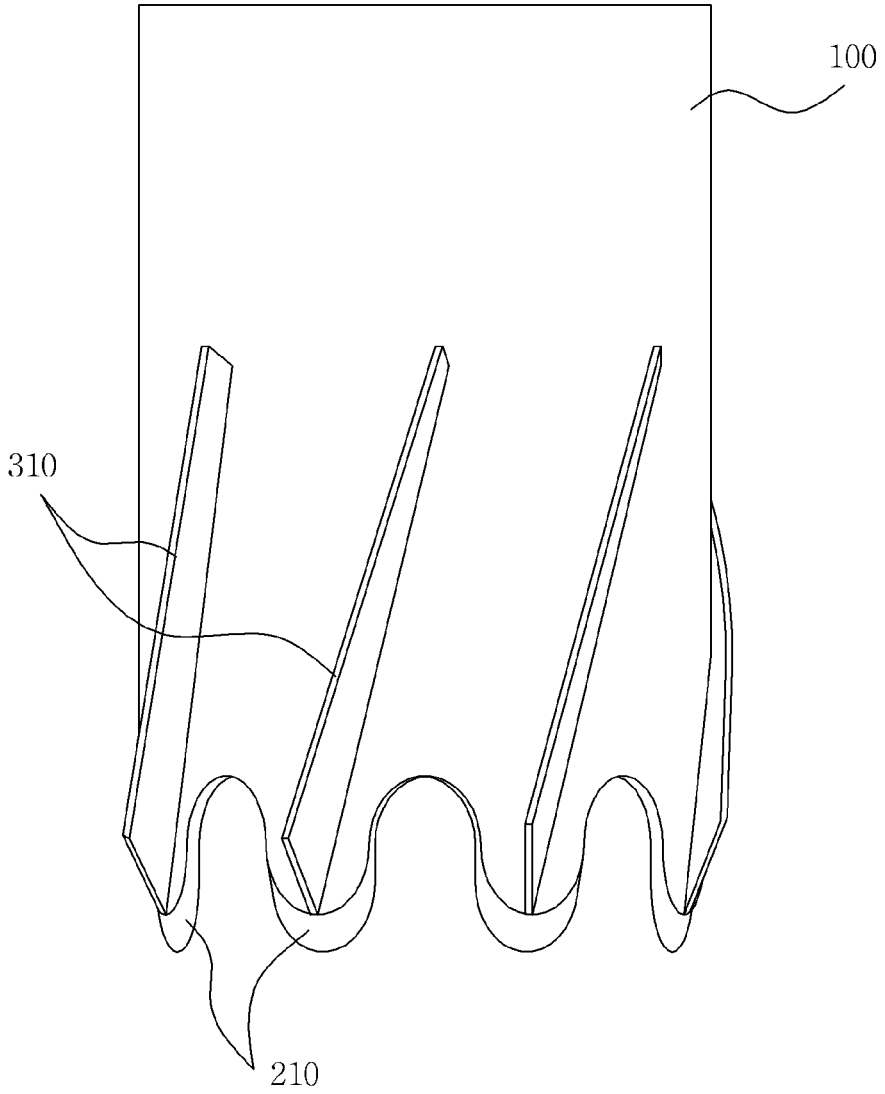
FIG. 5 is a front view showing a reinforcing blade according to yet another embodiment of the present invention.

Meanwhile, as shown in FIG. 1, the reinforcing blade 310 may vertically protrude from the circumferential surface of the hollow caisson 100, while extending in a longitudinal direction of the hollow caisson 100. Further, as shown in FIG. 5, the reinforcing blade 310 may protrude from the circumferential surface of the hollow caisson 100 to form a helical shape or a screw shape.

Here, since the reinforcing blade 310 protrudes from the outer circumferential surface or the inner circumferential surface of the hollow caisson 100, the reinforcing blade 310 guides a penetrating direction of the hollow caisson 100 when the hollow caisson 100 penetrates into the seabed.

That is, when the reinforcing blade 310 vertically protrudes along the longitudinal direction of the hollow caisson 100, the reinforcing blade 310 guides vertical penetration of the hollow caisson 100, and when the reinforcing blade 310 protrudes from the outer circumferential surface to form the screw shape, the reinforcing blade 310 induces the hollow caisson 100 to rotate in the direction forming the screw shape when the hollow caisson 100 penetrates into the seabed. Accordingly, the hollow caisson 100 can be more efficiently penetrated into the seabed by the guidance of the reinforcing blade 310.

The construction method of the suction foundation having the above-mentioned configuration will be described in reference to FIG. 6 and FIGS. 7A to 7E.

Figure 6:
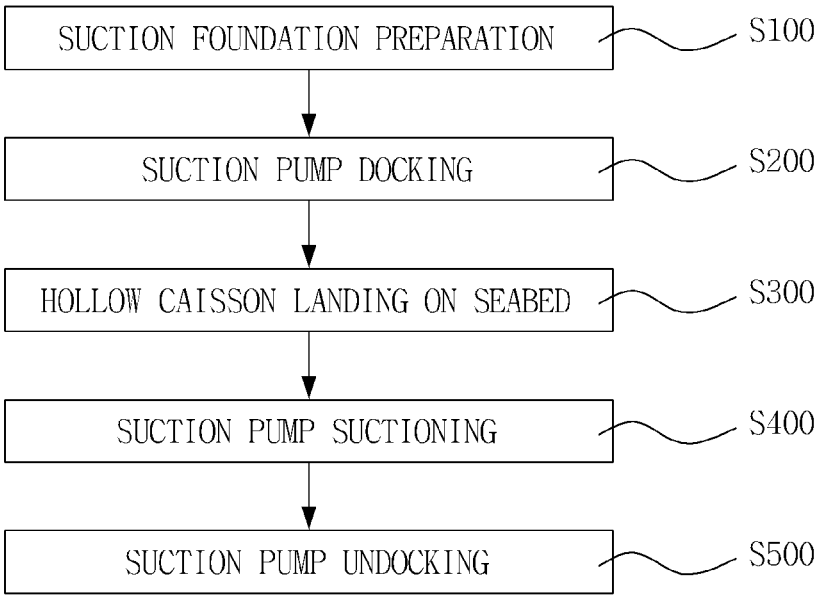
FIG. 6 is a block diagram showing a construction method of the suction foundation according to the present invention.

As shown in FIG. 6, the construction method of the suction foundation according to the present invention may include: preparing the suction foundation (S100); docking the suction pump (S200); landing the hollow caisson (S300); suctioning the fluid (S400); and undocking the suction pump (S500).

Figure 7A:
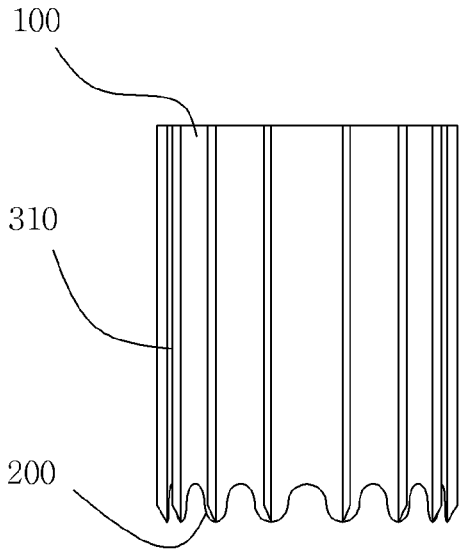
FIGS. 7A to 7E are views for describing the construction method of the suction foundation according to the present invention.

As shown in FIG. 7A, in the preparing the suction foundation (S100), the hollow caisson 100 provided with the above-mentioned reinforcing blade 310 protruding from the lower skirt 200 is constructed. Here, the hollow caisson 100 is made of steel or concrete.

Figure 7B:
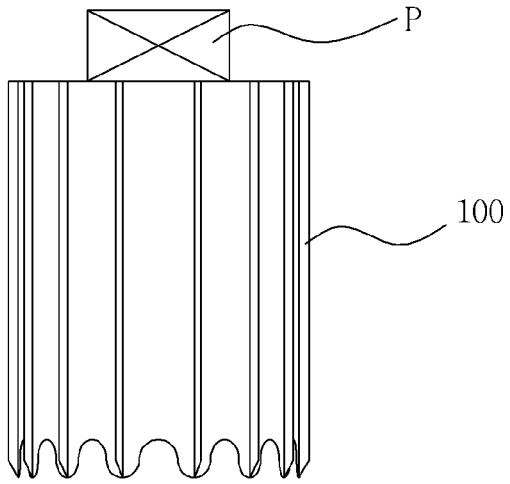

As shown in FIG. 7B, in the docking the suction pump (S200), the suction pump P is connected to the upper end of the hollow caisson 100.

Figure 7C:
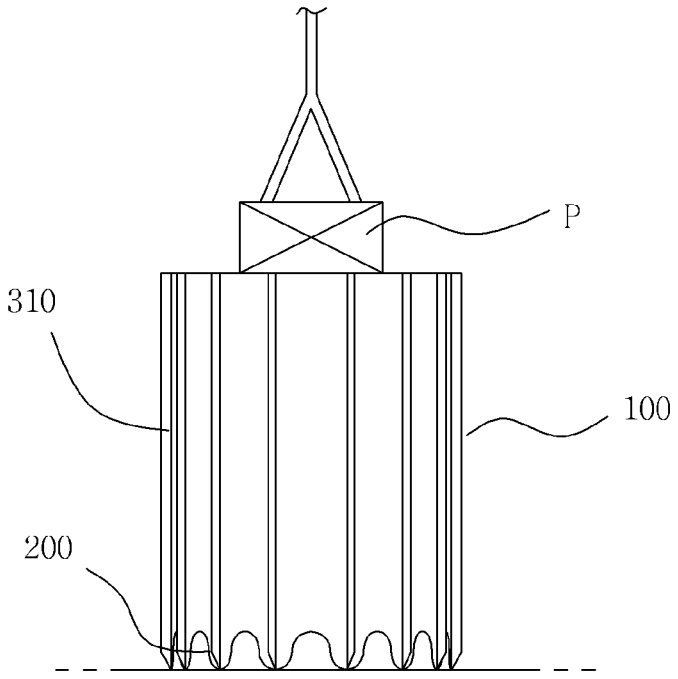

In the landing the hollow caisson (S300), the hollow caisson 100 is landed on the seabed. Here, as shown in FIG. 7C, the hollow caisson 100 is landed on the seabed by a lifting machine such as a crane, which can lift and lower the hollow caisson 100.

When the hollow caisson 100 is landed on the seabed as described above, the hollow caisson 100 can penetrate into the seabed to a predetermined depth by its own weight due to the teeth 210 constituting the lower skirt 200 of the hollow caisson 100.

Figure 7D:
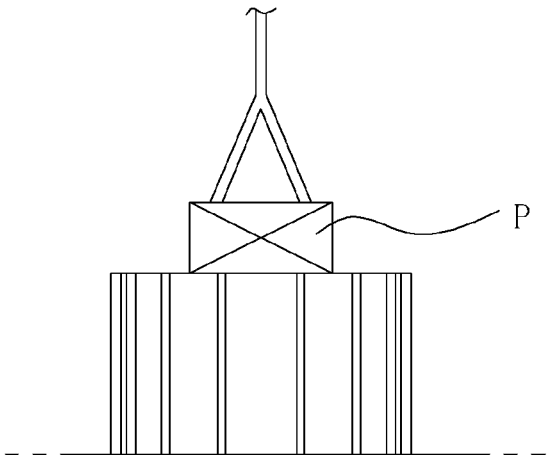

In the suctioning the fluid (S400), the hollow caisson 100 is penetrated into the seabed by using the vacuum pressure created in the hollow caisson 100 while the suction pump P discharges the fluid (seawater) in the hollow caisson 100 to the outside thereof by operation of the pump. Accordingly, as shown in FIG. 7D, the hollow caisson 100 is penetrated into the seabed by the vacuum pressure.

When the hollow caisson 100 is penetrated into the seabed, the hollow caisson 100 is guided by the reinforcing blade 310. Here, when the reinforcing blade 310 is configured to have a screw shape, the hollow caisson 100 can rotate during the penetration into the seabed.

Here, since the rigidity of the lower skirt 200 is increased by the reinforcing blade 310, the lower skirt efficiently penetrates into the seabed without being deformed or damaged.

Figure 7E:
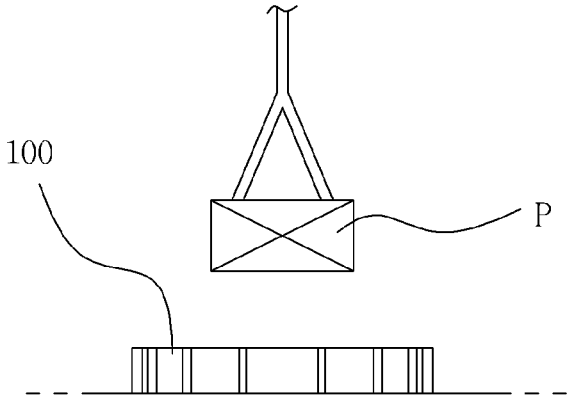
Figure 8:
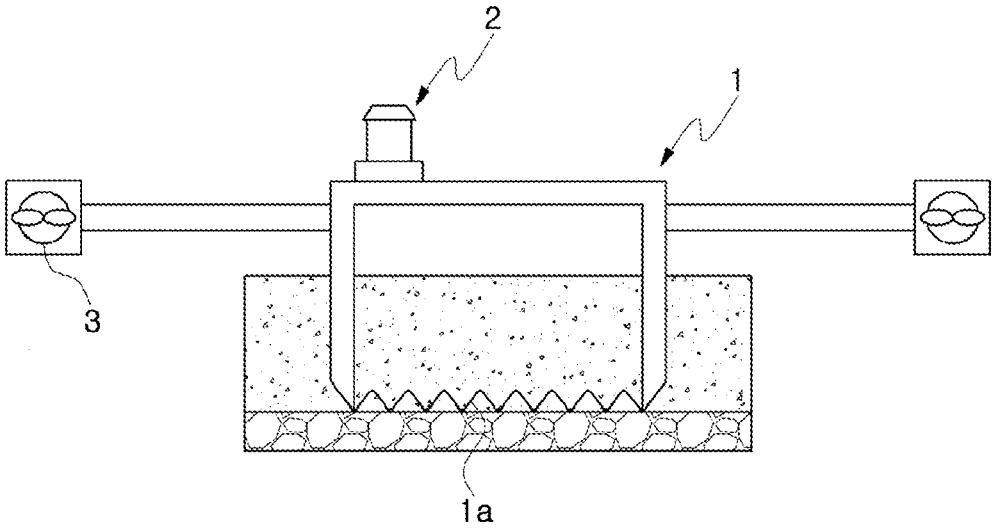
FIG. 8 is a view showing the constitution of a suction foundation according to a related art technology.

In the undocking the suction pump (S500), the suction pump P is removed from the hollow caisson 100, as shown in FIG. 7E, after the penetration of the hollow caisson 100 is completed.

Meanwhile, when it is required to remove the penetrated hollow caisson 100 from the seabed, seawater is introduced into the hollow caisson 100 by the suction pump P, thereby creating positive pressure in the hollow caisson 100. Due to the positive pressure created in the hollow caisson 100, the hollow caisson 100 can be removed from the seabed by being pulled from the seabed.

Although preferred embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A suction foundation having enhanced self-weight penetration, the suction foundation pentrating into a seabed by vacuum pressure of a suction pump, and providing a foundation support force, the suction foundation comprising:

a hollow caisson having an opening at a lower end thereof and formed into a tub shape, the hollow caisson introducing fluid on a seabed through the opening thereinto while the hollow caisson is landed on the seabed by its own weight, the suction pump being connected to the hollow caisson, the suction pump allowing the hollow caisson to penetrate into the seabed while discharging the fluid in the hollow caisson to an outside thereof by using the vacuum pressure of the suction pump;

a lower skirt provided along a circumference of the opening of the hollow caisson and formed into a wave shape having a series of teeth, and having wedge-shaped cross-sections, the lower skirt penetrating into the seabed using the teeth thereof when the hollow caisson is landed initially on the seabed by its own weight; and a stiffener increasing rigidity of the lower skirt by increasing thickness of a predetermined portion of the lower skirt, wherein, the stiffener includes a reinforcing blade protruding from each of the teeth that constitute the lower skirt and extending along a longitudinal direction of the hollow caisson, the reinforcing blade increasing the rigidity of the teeth.

2. The suction foundation of claim 1, wherein the reinforcing blade protrudes from at least one surface of an outer circumferential surface and an inner circumferential surface of the hollow caisson.

3. The suction foundation of claim 1, wherein the reinforcing blade vertically protrudes along the longitudinal direction of the hollow caisson.

4. The suction foundation of claim 1, wherein the reinforcing blade protrudes along the longitudinal direction of the hollow caisson to form a helical shape or a screw shape.

5. A method of constructing a suction foundation of any one of claim 1, 2, or 4, the method comprising the steps of:

preparing the suction foundation by constructing a hollow caisson provided with a reinforcing blade protruding from a lower skirt of the hollow caisson;

docking a suction pump on the hollow caisson by connecting the suction pump to the hollow caisson;

landing the hollow caisson on a seabed after putting the hollow caisson into the sea;

suctioning fluid from hollow caisson to cause the hollow caisson to penetrate into the seabed while discharging the fluid in the hollow caisson to an outside of the hollow caisson by operation of the suction pump; and undocking the suction pump from the hollow caisson by removing the suction pump therefrom, wherein, in preparing the suction foundation, the reinforcing blade is provided protruding from the lower skirt and the hollow caisson to form a helical shape or a screw shape, and in the suctioning, the hollow caisson is rotated by the reinforcing blade having the helical shape or the screw shape during penetration of the hollow caisson into the seabed.

* * * * *